United States Patent [19]

Eisler

[11] Patent Number: 4,570,918

[45] Date of Patent: Feb. 18, 1986

[54] FEEDER AND BOTTOM STACKER

[75] Inventor: David Eisler, Littleton, Colo.

[73] Assignee: Xerox Corporation, Stamford, Conn.

[21] Appl. No.: 673,072

[22] Filed: Nov. 19, 1984

[51] Int. Cl.[3] ..... B65H 31/08

[52] U.S. Cl. ..... 271/3.1; 271/195; 271/196; 271/212; 271/902

[58] Field of Search ..... 271/212, 195, 196, 3.1, 271/902

[56] References Cited

U.S. PATENT DOCUMENTS

| | | | |
|---|---|---|---|
| 3,498,599 | 3/1970 | Smith | 271/68 |
| 3,947,018 | 3/1976 | Stange | 271/99 |
| 3,955,813 | 5/1976 | Edwards | 271/174 |
| 4,099,789 | 7/1978 | Zaglio | 302/2 R |
| 4,130,274 | 12/1978 | Stange | 271/236 |
| 4,168,831 | 9/1979 | Rebel | 271/177 |
| 4,229,861 | 10/1980 | Campo et al. | 19/161.1 |
| 4,275,877 | 6/1981 | Silverberg | 271/166 |
| 4,305,576 | 12/1981 | Hamlin | 271/11 |
| 4,317,563 | 3/1982 | Zimmerman et al. | 271/211 |
| 4,353,542 | 10/1982 | Knight | 271/212 X |
| 4,478,404 | 10/1984 | Garavuso | 271/196 X |

*Primary Examiner*—Richard A. Schacher

*Attorney, Agent, or Firm*—William A. Leary, II

[57] ABSTRACT

Apparatus for removing the bottom sheets from a stack of sheets or inserting sheets at the bottom of a stack of sheets including an air knife to provide an air cushion between the stack of sheets and the bottom sheet in the stack and a reversible drive roll mounted within a vacuum plenum for driving sheets beneath or away from the sheet stack.

6 Claims, 7 Drawing Figures

FEEDER AND BOTTOM STACKER

BACKGROUND OF THE INVENTION

In many environments, particularly xerographic reproduction machines, it may be desirable to provide a sheet feeder wherein the sheets are removed from the bottom of a stack. Bottom feeders are particularly useful for feeding blank sheets of copy paper into a copy machine to enable continual replenishment of the stack without stopping operation of the machine as is necessary with top sheet feed devices. Further, if the sheet feeding device is to be utilized for feeding documents to the platen of a copy machine for imaging thereat, it may be desirable to feed from the bottom of the stack to maintain the proper pagination so that the output from the copy machine is pre-collated. In certain modes of operation, it may also be desirable to insert the copied document into the bottom of a stack of documents already copied so that the proper page orientation is maintained to enable subsequent copying in the proper order.

It is therefore an object of the present invention to provide a feeder-stacker apparatus for inserting sheet seriatim into a stack or removing the sheets individually from the bottom of the stack.

SUMMARY OF THE INVENTION

The instant invention relates to an apparatus for inserting sheets under a stack of sheets or removing sheets seriatim from the bottom of the stack and comprises a paper tray having side members, a porus rear stop and a curvilinear bottom surface that is sloped from the front of the tray to the rear stop. An air knife is located in front of the tray and includes vanes therein that direct air pressure at acute angles towards the tray. A vacuum means is positioned within a front portion of the bottom surface of the tray with a reversible roller means located therein, said reversible roller means being adapted to drive sheets into the tray when rotated in a first direction and drive sheets out of the tray when rotating in a second direction.

DESCRIPTION OF THE PREFERRED EMBODIMENT

Figure 1:
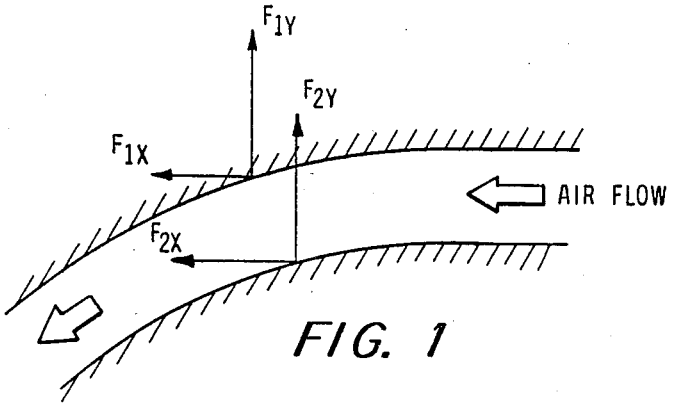
FIG. 1 is a side view schematic diagram indicating how fluid passing around a curve generates forces on a surrounding structure.
Figure 2:
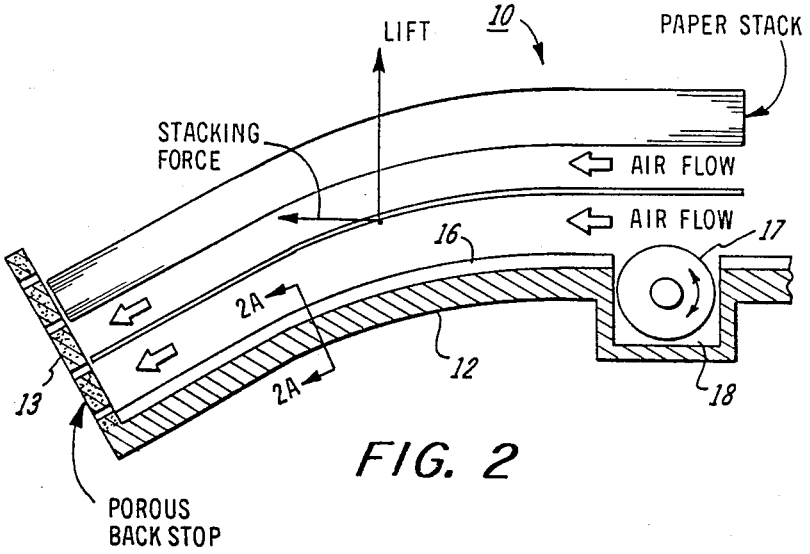
FIG. 2 is an exploded partial side view of the feeder-stacker according to the instant invention.

The feeder-stacker of the present invention is based on the principle that fluid passing around a curve generates forces on the surrounding structure as depicted in FIG. 1. As shown, force components are generated within a channel in both the X and Y directions on the top and bottom surfaces of the channel as fluid presses therethrough. As a result, small air requirements and light forces are used by the apparatus of FIG. 2 in accordance with the present invention to levitate, feed and/or bottom stack paper or sheets of any kind. The general configuration of the stacker-feeder 10 in FIG. 2 is similar to a vacuum corrugation feeder (VCF) as disclosed, for example, in U.S. Pat. No. 4,305,576 which is incorporated herein by reference, but the principle of levitation and some structure improvements are new. Whereas the previously mentioned VCF lifts paper by inflating an air pocket between sheets one and two, the stacker-feeder 10 is based on the principle that fluid passing around a curve generates forces on the surrounding structure.

Figure 3:
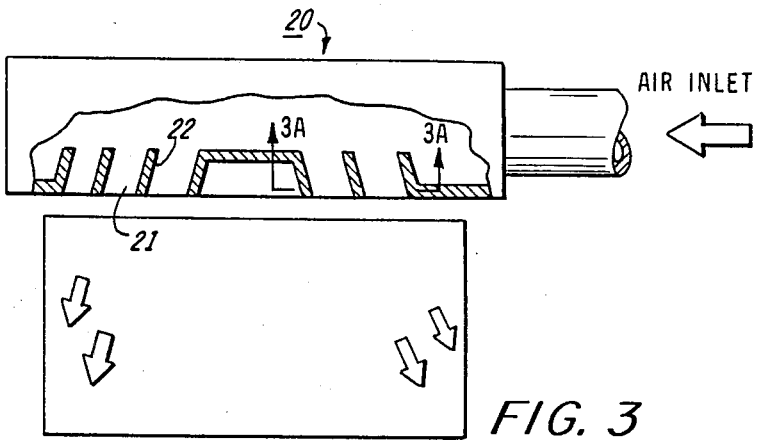
FIG. 3 is a plan view of the air knife used in the instant invention.
Figure 3A:
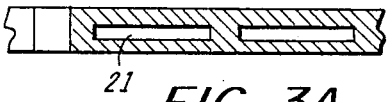
FIG. 3A is a front elevational view showing the shape of the nozzles in the air knife of FIG. 3 taken along line 3A—3A.

As shown in FIG. 2, the principle of 1, is incorporated into the stacker-feeder apparatus 10 to lift and stack paper by curving paper tray 12 such that it is air foil shaped and by supplying air to the front of the paper tray with an air knife 20 as shown in FIG. 3. If desired, protruding ribs 16 could be placed on the bottom surface of paper tray 12 in order to reduce the pull out/-push in force requirement by reducing the surface contact area, reducing tacking by permitting air to flow below sheet one and equalize pressures, and improve levitation by directing air where it is needed. Air knife 20 has thin rectangular nozzles 21 that are more clearly shown in FIG. 3A. The nozzles have internal vanes 22 for limiting waste and directing air toward the corners of the paper stack where it is needed most for lifting purposes. In order for the stacker-feeder to accommodate 14" paper or paper larger than $8\frac{1}{2}'' \times 11''$ more nozzles of the air knife are provided to supply air to the non-registration side and end of tray 12 than the registration side of the tray or the right hand side of the paper as viewed in FIG. 3. A reversible drive roll 17 stretches the entire width of tray 12 and is positioned within a vacuum chamber 18 which pulls sheets to the frictional surface of roll 17 for transport into or out of tray 12. In practice, the curved tray and rectangular shaped nozzles of the present invention provide complete visible separation (a clean gap between the stack and the tray) for as much as a 50 sheet stack of $8.5'' \times 14''$ paper. To pull out the bottom sheet of a fifty sheet stack of 4024 DP substrates requires 0.05 lbs of pressure and to push a sheet completely under the stack requires 0.06 lbs of pressure; far less than the pressure that would be required to buckle a sheet in a VCF.

Figure 4:
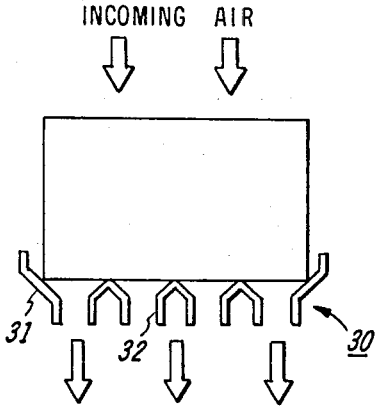
FIG. 4 is a plan view of an air concentrator in accordance with the present invention.
Figure 5:
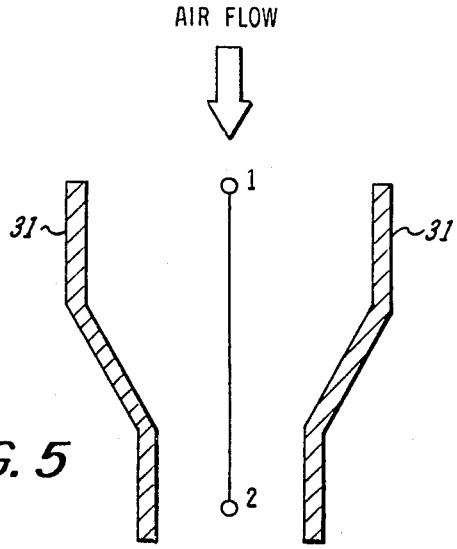
FIG. 5 is an exploded partial plan view of the air concentrator of FIG. 4.

An additional feature that could be included with the stacker-feeder 10 is shown in FIG. 4 as an air concentrator 30 which is positioned at the back of the stack. The air concentrator includes multiple angled side members 31 and rear stack inhibitors 32 that allow air to escape through the back of the tray while inhibiting further backward movement of the stack. The concentrator increases pressure below the stack without increasing impedance by using Bernoulli's principle. For example, assuming no losses, the velocity at 2 in FIG. 5 is greater than at 1. From Bernoulli's static equation, static pressure must be greater at 1 (below the stack) than at 2 (in the constricted portion of the concentrator).

Figure 2A:
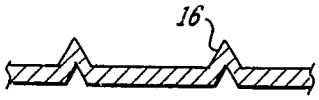
FIG. 2A is a view taken along line 2A—2A of FIG. 2 showing ridges protruding from the base plate of the feeder-stacker of the present invention.

Instead of the simple ribs of FIG. 2A being positioned on tray surface 12, several variations for enhancing sheet stacking and feeding could be employed. For example, depressed grooves could be placed in the bottom of tray 12 in a parallel or angled relationship with respect to the sides of the tray in oder to put more moving air under a sheet and thereby generate more lift at the back of the tray where it is needed. In addition, contracting the grooves at the back of the tray could be employed to also increase upward momentum on sheets. Alternatively, the grooves could be expanded at the back of the tray to increase static pressure. Another alternative is the use of ribs as shown in FIG. 2A that either expand or contract toward the rear of the tray. The ribs could also have ramp portions on their ends at the rear of the tray if desired.

In operation of the stacker-feeder in the sheet stacking mode, a sheet is forwarded to tray 12 by conventional means until it reaches vacuum chamber 18 whereupon the vacuum applied to the sheet by way of chamber or plenum 18 pulls the sheet against the drive roller 17 which is operating in a counterclockwise direction by a conventional controller. In addition, air pressure from air knife 20 helps to force the sheet against the bottom of the tray and roll 17 for forward movement into the tray. The tray has a porous backstop 13 in order to allow for the escape of air. As a second sheet enters the tray, air pressure from air knife 20 lifts up sheet one so that sheet two can be inserted under it and so forth until the stacking is completed. Air requirements for the present invention will be relatively small in relation to prior devices for two reasons. First, air from air knife 20 is directed to where it is most needed by vanes 22 and ribs 16 reducing waste. Second, the bottom sheet lies flat in the tray so that it can be pulled out or pushed under the stack with a minimum vacuum. In current VCF's the bottom sheet is stretched and contorted as it moves over the pocket and corrugation member, wasting energy and increasing power requirements. The smaller air requirement of the present invention leads to a smaller blower, lower power consumption and less noise. When operating stacker-feeder 10 in a feeding mode, air knife 20 provides a separation between sheet one at the bottom of the stack and the rest of the stack by levitating the stack while sheet one is also being drawn to reversible roll 17 by a vacuum in vacuum chamber or plenum 18. The sheet is frictionally engaged by roll 17 and forwarded out from under the stack into the transport system of the machine of which it is a part. This process continues until the stack is depleted. In this mode, stacker-feeder 10 operates quite similar to the VCF disclosed in U.S. Pat. No. 4,305,576.

By suitable valving and controls, it is desirable to provide a delay between the time the vacuum is applied to pull sheet one onto roll 17 and the start up of the roll to insure that sheet one is captured on the roll before clockwise movement of the roll commences and to allow time for the air knife to separate sheet one from any sheet that might be pulled down with it.

The stacker-feeder 10 has several advantages over devices used heretofore, for example, reduced shingle feeding is obtained due to: (1) a large even gap between sheets one and two, and (2) the retarding force on sheet two from the curved air flow from air knife 20. Also, less coincident feeding occurs because the flow from air knife 20 actually pulls up on sheet two. Further, less paper skewing is encountered because drive out/in roll 17 is as wide as the paper resulting in a better grip on each sheet. Extra wide sheet skew and misfeed is less because the air knife lifts and separates the extra width just as well as the rest of the sheet due in large part to the design of the nozzles of the air knife. Some VCF's now in use lift stacks only in the "pocket" region and performance of large sheets which overhang the pocket is not at the optimum one would like. With the present invention, cross curled and down curled sheets are handled well because the tray curvature breaks cross curl and negates down curl without adding unnecessary contortions to the bottom sheet.

In summary, a stacker-feeder is disclosed that is capable of inserting sheets beneath a stack of sheets or removing sheets individually from the bottom of the stack and comprises a stack tray that has a curved configuration and a vacuum plenum positioned in a front portion of the bottom surface of the tray. A reversible roll is located within the vacuum plenum and is adapted to either drive sheets into or out of the tray. An air knife is positioned in front of the tray and adapted to separate sheet one from sheet two in the sheet stack and to lift the stack so that sheet one can be fed from the stack or a sheet can be fed underneath the stack.

What is claimed is:

1. A stacker-feeder for inserting sheet under the bottom of a sheet stack or removing sheets from the bottom of the stack individually, comprising:

a paper tray having a curvilinear bottom and a porous backstop;

an air knife positioned in front of said tray and adapted to supply air to said curvilinear bottom of said tray such that forces are generated on sheets entering the stack as well as the stack itself in order to lift the stack and lift sheets up to the stack;

a vacuum plenum located in a front portion of the bottom of said tray; and, a reversible drive roll positioned within said vacuum plenum and adapted to drive a sheet into and out of the stack once they have been attracted thereto by the vacuum of said vacuum plenum.

2. The stacker-feeder of claim 1, wherein said curvilinear bottom of said tray includes a plurality of ribs extending therefrom which are adapted to present a minimal frictioned surface to sheets coming into or leaving said tray.

3. The stacker-feeder of claim 1, wherein said tray includes a registration edge and said air knife includes a plurality of thin rectangular nozzles with a majority of said nozzles being directed toward the non-registration edge side of said tray.

4. The stacker-feeder of claim 3, wherein said nozzles include a plurality of vanes which direct air from said air knife away from the center of the sheet stack and toward the rear corners of the stack in order to enhance sheet stacking and feeding of a wide variety of sheet sizes.

5. The stacker-feeder of claim 1, wherein said paper tray includes air concentrator means at the rear of said tray.

6. The stacker-feeder of claim 5, wherein said air concentrator includes openings to allow air to escape through the rear of said tray and a series of point surfaces that resist rearward movement of the sheet stack.

* * * * *